United States Patent [19]

Campbell et al.

[11] Patent Number: 5,076,620

[45] Date of Patent: Dec. 31, 1991

[54] FLUSH BOLT MECHANISM FOR DOUBLE DOORS

[75] Inventors: Andrew B. Campbell, San Marino; Ira J. Simon, Long Beach, both of Calif.

[73] Assignee: Triangle Brass Manufacturing Company, Los Angeles, Calif.

[21] Appl. No.: 521,222

[22] Filed: May 9, 1990

Related U.S. Application Data

[62] Division of Ser. No. 226,467, Aug. 1, 1988, abandoned.

[51] Int. Cl.[5] ..... E05C 9/07

[52] U.S. Cl. ..... 292/138; 292/46; 292/166; 292/92; 292/DIG. 21

[58] Field of Search ..... 292/92, 182, 216, 167, 292/169.19, DIG. 62, 139, 177–181, 152, 168, 137, 138, 145, 147, DIG. 21, 149, 337, 46, 166

[56] References Cited

U.S. PATENT DOCUMENTS

| | | | |
|---|---|---|---|
| 52,570 | 2/1866 | Havell . | |
| 412,986 | 10/1889 | Schoen et al. . | |
| 1,086,126 | 2/1914 | Berry . | |
| 1,162,945 | 12/1915 | Ohnstrand . | |
| 1,378,622 | 5/1921 | Sarbij . | |
| 1,394,962 | 10/1921 | Bate . | |
| 1,559,160 | 10/1925 | Carter . | |
| 1,670,430 | 5/1928 | Alexander . | |
| 1,721,162 | 7/1929 | Moore . | |
| 1,847,686 | 3/1932 | Bienaime . | |
| 1,983,125 | 12/1934 | Ellison | 16/129 |
| 2,035,033 | 3/1936 | Wakefield | 292/145 |
| 2,062,176 | 11/1936 | Hennigan | 292/64 |
| 2,079,895 | 5/1937 | Brooks | 292/164 |
| 2,161,930 | 6/1939 | Niswonger et al. | 292/182 |
| 2,201,444 | 5/1940 | Marsh | 292/165 |
| 2,202,916 | 6/1940 | Mussa | 292/177 |
| 2,251,038 | 7/1941 | Danen | 292/145 |
| 2,253,547 | 8/1941 | Adams | 70/208 |
| 2,281,317 | 4/1942 | McFarlane | 292/164 |
| 2,459,571 | 1/1949 | Mihalek et al. | 312/186 |
| 2,819,107 | 1/1958 | Muessel | 292/143 |
| 2,910,857 | 11/1959 | Muessel | 70/92 |
| 3,103,114 | 9/1963 | Atkinson | 70/71 |
| 3,556,573 | 1/1971 | Miller | 292/143 |
| 3,578,369 | 5/1971 | Coopersmith | 292/58 |
| 3,582,122 | 6/1971 | Foster | 292/335 |
| 3,705,739 | 12/1972 | Adler | 292/92 |
| 3,811,717 | 5/1974 | Floyd et al. | 292/92 |
| 4,005,886 | 2/1977 | Lirette | 292/177 |
| 4,098,101 | 7/1978 | Svoboda | 70/134 |
| 4,157,197 | 6/1979 | Wilson | 292/179 |
| 4,315,647 | 2/1982 | Wilzig et al. | 292/143 |
| 4,445,717 | 5/1984 | Imhoff | 292/177 |
| 4,611,840 | 9/1986 | Martin | 292/177 |

OTHER PUBLICATIONS 3 pages of Precision Hardware, Inc. brochure No. 1040.
7 pages of Ives Brochure, 4/82.
8 pages of Door Controls International Brochure "840/940 Series".
9 pages of Glynn-Johnson's Brochure, 1981.

*Primary Examiner*—Richard E. Moore
*Attorney, Agent, or Firm*—Lyon & Lyon

[57] ABSTRACT

A flush bolt including override protection is disclosed for flush mounting on the inactive one of a pair of swinging doors. In one embodiment of the invention, an automatic flush bolt comprising a trigger member senses whether the active door is closed. If closed, the flush bolt assumes an engaged position securing a bolt into a securing surface. If open, the flush bolt assumes its disengaged position with the bolt retracted into the mechanism. In a second embodiment of the invention, a semi-automatic flush bolt is provided with a slotted member and a spring to bias the bolt toward the engaged position. When the door containing the mechanism is closed, the bolt may temporarily and automatically override the securing surface and engage the securing surface without damage to the mechanism, the door, or the door frame. Opening the door requires manual intervention through activation of a control member. In both embodiments, biasing toward a preselected position of the flush bolt is provided by a single helical spring under compression.

49 Claims, 3 Drawing Sheets

FIG. 1.
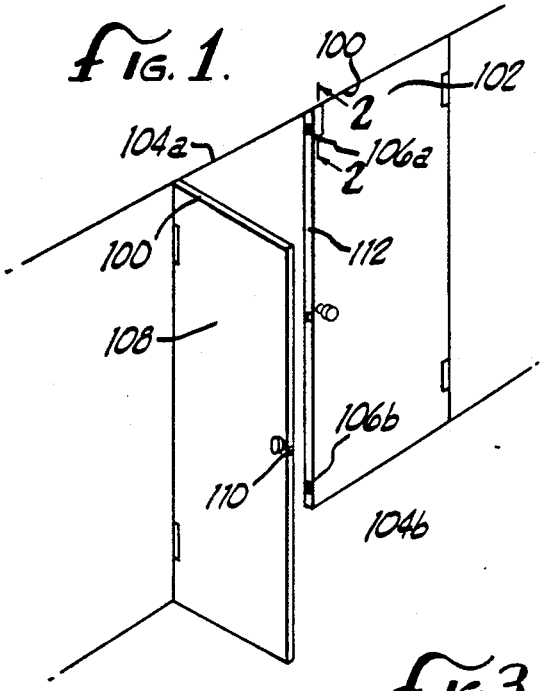
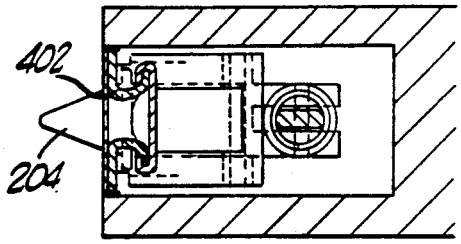
FIG. 4.
FIG. 3.
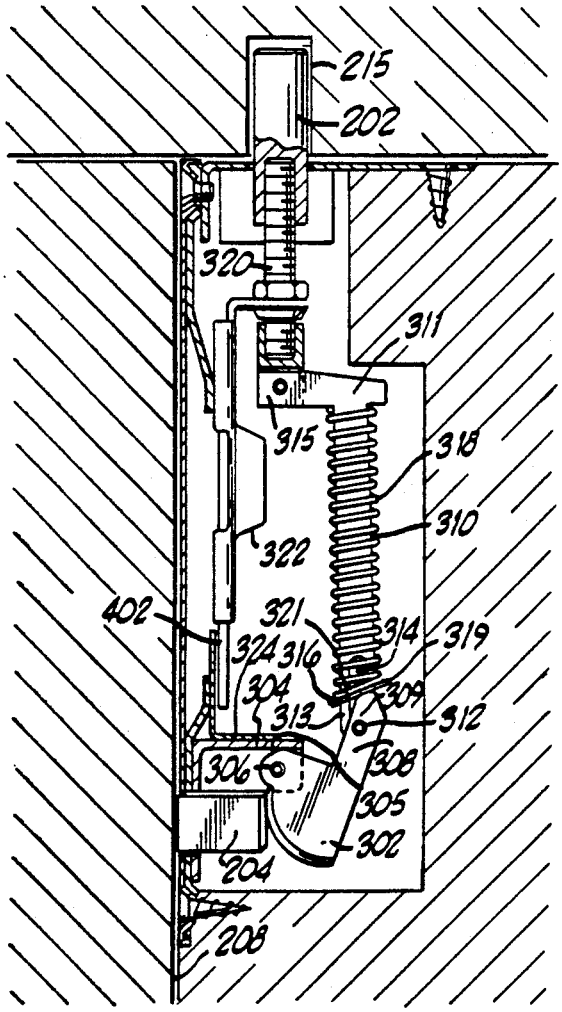
FIG. 2.
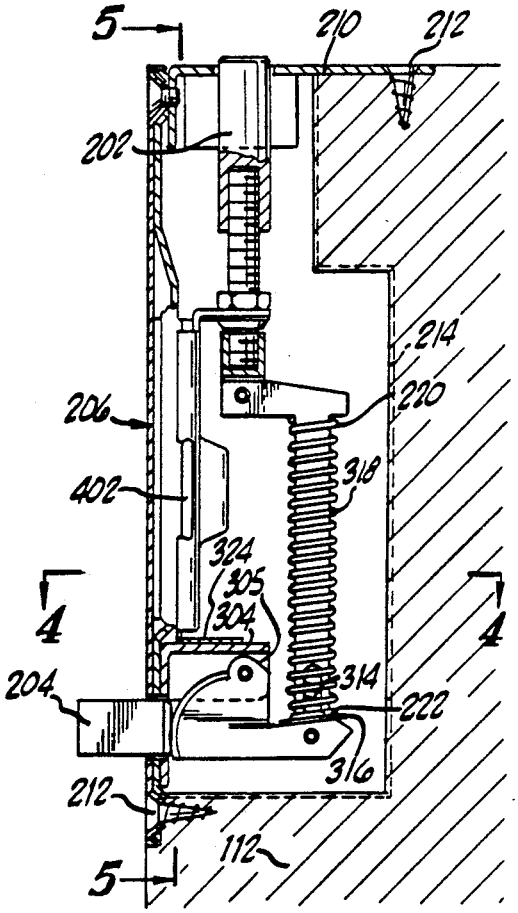

FLUSH BOLT MECHANISM FOR DOUBLE DOORS

RELATED CASES

The present invention is a divisional of copending U.S. Ser. No. 226,467 filed Aug. 1, 1988. U.S. Ser. No. 226,467 was abandoned in favor of copending continuation U.S. Ser. No. 530,467 filed May 29, 1990 which is now U.S. Pat. No. 5,004,277, issued Apr. 2, 1991.

BACKGROUND OF THE INVENTION

The present invention relates to latches or bolts used in doors. More particularly it relates to a particular type of door bolt used for bolting the inactive one of a pair of swinging double doors. More particularly the present invention relates to bolts mounted flush with the free edge of one of a pair of swinging double doors for bolting the inactive door to the door frame. Bolts of this type are referred to as flush bolts. In typical application, one or two flush bolts may be used in an installation. Typically one bolt is used to bolt the top of the inactive door to the ceiling or top of the door frame and one bolt is used to bolt the bottom of the inactive door to the floor or bottom of the door frame. Flush bolts may be manual, semiautomatic, or automatic. A manual flush bolt must be operated by hand in order to open or close the door. A hand-operated switch or lever controls the position of the bolt between an engaged position and a disengaged position. In a semi-automatic flush bolt, the door may close and latch itself automatically, but a hand-operated control lever or switch must be manually activated in order to release the bolt to open the door. In an automatic flush bolt, a trigger or sensor on the free edge of the inactive door senses whether or not the active door is closed, i.e. is adjacent to it. When the active door is closed, the trigger causes the automatic flush bolt to change to the engaged position, when the active door is again open, the trigger releases causing the automatic flush bolt to return to the disengaged position.

Although fit for their intended purposes, semi-automatic and automatic flush bolts of the prior art feature complicated structures and large numbers of parts. Typically two or more springs are necessary within the mechanism in order to achieve proper biasing of the various parts.

SUMMARY OF THE INVENTION

The present invention is directed to a flush bolt for use in latching the inactive one of a pair of swinging double doors. To this end, a bolt-slide assembly capable of sliding between an engaged and a disengaged position is provided. The bolt-slide assembly is biased toward a preselected position, i.e. engaged or disengaged. This is sometimes referred to herein as position bias.

Accordingly it is an object of the present invention to provide an improved flush bolt having simpler construction which may be more easily and economically manufactured.

Another object of the present invention is to provide a flush bolt having novel structural features for biasing the flush bolt to a predetermined position, i.e. engaged or disengaged. Other and further objects and advantages will appear hereinafter.

BRIEF DESCRIPTION OF THE DRAWINGS

FIG. 1 is a perspective view of a pair of double doors incorporating the flush bolts of the present invention.

FIG. 2 is a cross-sectional view taken along lines 2—2 of FIG. 1 of an Automatic Flush Bolt according to the present invention in a disengaged position.

FIG. 3 is a cross-sectional view taken along lines 2—2 of FIG. 1 of an Automatic Flush Bolt according to the present invention in an engaged position.

FIG. 4 is a cross-sectional view taken along lines 4—4 of FIG. 2 of an Automatic Flush Bolt according to the present invention in a disengaged position.

DESCRIPTION OF THE PREFERRED EMBODIMENTS

Figure 5:
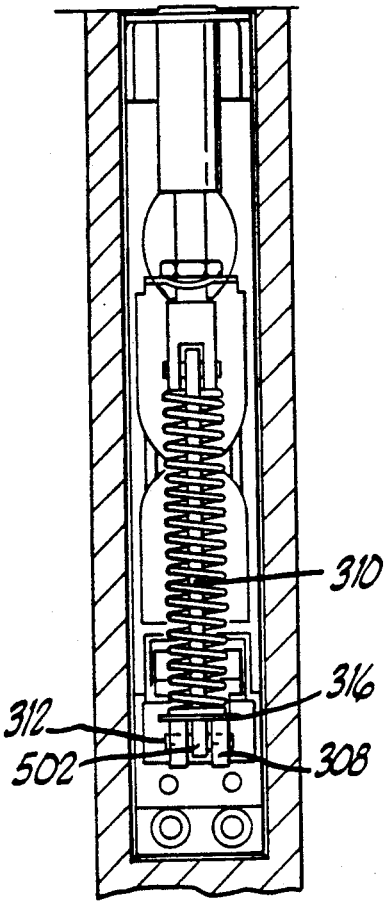
FIG. 5 is a cross-sectional view taken along lines 5—5 of FIG. 2 of an Automatic Flush Bolt according to the present invention in a disengaged position.
Figure 6:
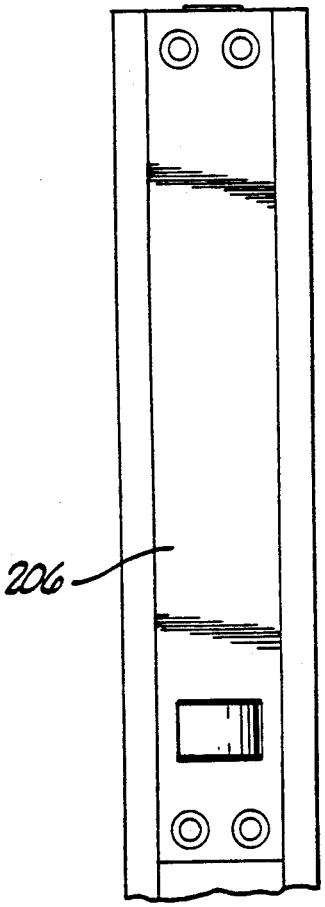
FIG. 6 is a front elevation of an Automatic Flush Bolt according to the present invention in a disengaged position.

The present invention relates to flush bolts for use in one of a pair of swinging doors. Flush bolts are used to secure one of a pair of double swinging doors, known in the art as the "inactive door". Typically the inactive door may be secured to the door frame at the top and/or bottom of the door. In this way the door is bolted shut to the door frame and the free swinging door may itself be locked or bolted shut by sliding a bolt home into the free edge of the inactive door upon shutting the active door. FIG. 1 shows an arrangement of a pair of swinging double doors 100. The inactive door 102 remains shut and may be secured to a door frame, ceiling, floor or "securing surface" 104*a*, 104*b* through utilization of flush bolts 106*a*, 106*b*. Active door 108 remains free to open and close and may, for example, be latched to inactive door 102 in the conventional manner with conventional door hardware 110.

Flush bolts according to the present invention may be considered to be one of two types. The first type are referred to herein as "Automatic Flush Bolts" and the second type are referred to herein as "Semi-Automatic Flush Bolts". An Automatic Flush Bolt according to the present invention is disclosed in FIGS. 2, 3, 4, 5, 6, 10 and 11. A Semi-Automatic Flush Bolt according to the present invention is disclosed in FIGS. 7, 8 and 9.

Turning now to FIG. 2, an Automatic Flush Bolt is depicted in a relaxed state as if it were installed in inactive door 102 at 106*a* (upper position) or 106*b* (lower position). As depicted, bolt member 202 is retracted and door 102 may be opened or closed at will. This state is referred to as the disengaged position of the flush bolt.

The Automatic Flush Bolt according to a preferred embodiment of the invention includes a frame member 210 which is mounted to the door 102 by fastening means such as screws 212, rivets, nails, or other conventional means as well known in the art. The Automatic Flush Bolt operates by means of a trigger member 204. Trigger member 204 protrudes through a surface 206 adapted to be mounted essentially flush with the free edge 112 of one 102 of the pair of swinging doors 100. The flush mounting is accomplished in the conventional manner known to those of skill in the art and is depicted in FIGS. 1, 2, 3, 4, 7, 8 and 11. The Automatic Flush Bolt is conventionally mounted at one or both corners of the free edge 112 of the inactive door. Optionally, a housing 214 made of a suitable material such as metal covers the mechanism to protect against fire when installed in wooden or flammable doors, and as an aid in keeping dust or other extraneous matter away from the mechanism. Such housings are well known in the art and will not be discussed further herein.

Operation of the Automatic Flush Bolt causes the Automatic Flush Bolt to change from a disengaged state with bolt member 202 withdrawn as depicted in FIG. 2 to an engaged state with bolt member 202 extended so as to engage with a securing surface 104*a*, 104*b* at strike 215. The engaged state of an Automatic Flush Bolt according to a preferred embodiment of the present invention is depicted in FIG. 3.

Upon closure of active door 108, trigger member 204 is forced to lie substantially flush with surface 208. By a lost motion fit, trigger member 204 engages cam member 302 via a sliding contact. Cam member 302 (shown in more detail in FIG. 10) is pivotally attached to a bracket 304 which is a part of frame member 210 at pivot axis 306. Cam member 302 has an arm portion 308 which is connected to a link member 310. In a preferred embodiment, cam member 302 is rounded as indicated in the drawings. Link member 310 has a first end 311 and a second end 313. A spring anchor 315 may comprise a shoulder in the first end 311 of link member 310. Sprinq anchor 315 provides a point against which spring 318 may push. The connection of arm 308 to link member 310 is accomplished in one preferred embodiment by a slot 502 as depicted in FIG. 5 in arm 308 through which slotted link member 310 passes. Pin 312 locks the slot 314 of link member 310 to arm 308 at the distal end of arm 308 as shown in FIGS. 2, 3 and 5. Compression of trigger member 204 causes arm 308 to pivot counter-clockwise as shown in FIG. 3. In one preferred embodiment spring 318 may include a washer 316 arranged so that arm 308 presses against washer 316 which in turn presses against the helical coil of spring 318 which may be mounted coaxial with link member 310. Spring 318 has a first spring end 220 and a second spring end 222. In one preferred embodiment, the spring is fabricated from 50 coils of 0.047-inch diameter steel music wire having an outer diameter of 0.56 inches and an uncompressed spring length of 7.3 inches although other materials and dimensions could be used as would be apparent to those of skill in the art. Slot 314 provides room for relief in case bolt member 202 is constrained from movement while trigger 204 is depressed. This condition is referred to as "override" and it is necessary to provide override bias so that bolt member 202 may be moved to a retracted position when the flush bolt is in the engaged position. In the present invention, override bias and position bias are provided by a single spring 318. In this manner, damage to the Automatic Flush Bolt from an override condition will be prevented. Spring 318 coaxial with link member 310 biases the Automatic Flush Bolt to a preselected position which in the presently described preferred embodiment is the disengaged position of the flush bolt. Spring 318 is under compression in the preferred embodiment herein described.

Figure 10:
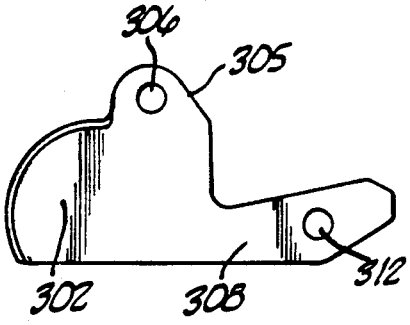
FIG. 10 is a front elevation of the cam member.

In a preferred embodiment of the invention, improved return action of the trigger to its extended position is obtained by use of a cam member 302 having a shape approximately like that depicted in FIG. 10. As set forth in FIGS. 2, 3, 10 and 11, cam member 302 has a raised portion 305 for making contact with bracket 304 and limiting the relative movement of cam member 302 with respect to bracket 304. Return action of cam member 302 to its extended position is provided by spring 318 in part because when cam arm 308 is pivoted counter-clockwise and extended upward against spring 318, further compressing spring 318, a differential compression of the spring occurs. Outer portion 319 of spring 318 becomes more compressed than inner portion 321 of spring 318 and as a result, a twisting bias is imparted by spring 318 to cam member 302 at cam arm end 309 aiding its return to the disengaged position.

In more detail, as cam member 302 rotates due to force and movement of trigger member 204, cam arm end 309 pivots around pin 312 decreasing the length of spring 318 and increasing the return force of spring 318.

It would be clear to those of skill in the art that the override relief provided by slot 314 could be provided at either end of link member 310 and need not be limited to the second end 313 as shown in the figures. For example, in such an embodiment, link member 310 could be slidably engaged at its first end with rod member 320 or an extension thereof. Link member 310 would be pivotally but not slidably connected to cam arm 308 and spring 318 would be under compression and bias cam arm 308 to a maximum distance from the first end of link member 310.

Figure 11:
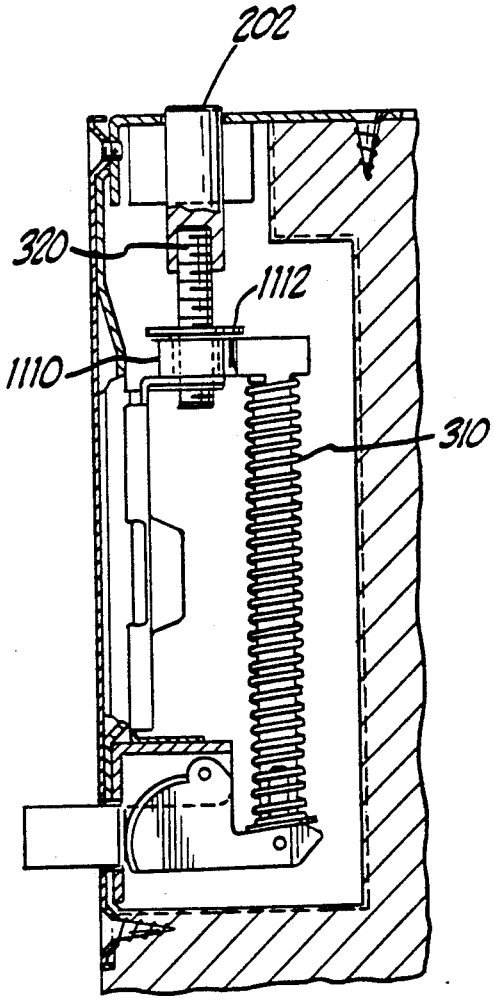
FIG. 11 is a cross-sectional view of an alternative embodiment of an Automatic Flush Bolt according to the present invention in a disengaged position.

Bolt member 202 of the preferred embodiment is a slightly bevelled cylindrical bolt attached to rod member 320. There are no particular constraints upon the cross-sectional shape of bolt member 202 as would be apparent to those of skill in the art. Rod member 320 attaches bolt member 202 to sliding member 322 and to link member 310. Attachment of link member 310 to bolt member 202 may be as it is depicted in FIGS. 2 and 3, however it is also possible to attach link member 310 to bolt member 202 via rod member 320 at a point closer to bolt member 202. This configuration is depicted in FIG. 11. In a preferred embodiment of the foregoing type, a loop 1112 is formed in an end of link member 310. Loop 1112 is adapted to receive rod member 320 and a T-nut 1110 is used to fix link member 310 to rod member 320.

Frame member 210 includes a track 402 as depicted in FIGS. 2, 3 and 4. Track 402 of one preferred embodiment may be a pair of rails pressed out of frame member 210 which slidably engage sliding member 322. In another preferred embodiment, track 402 may consist of a guide or series of guides attached to frame member 210 through which a sliding member could slidably engage frame member 210. For example, a sliding member of circular cross-section could be supported by a series of brackets having holes of similar cross-section therethrough. Track 402 is arranged to run substantially parallel to the free edge of the door and allow movement of sliding member 322 substantially parallel to the free edge of the door.

Sliding member 322 is locked to the motion of bolt member 202 and slides relative to the frame member.

The term bolt-slide assembly refers to the structure comprised of bolt member 202, rod member 320, sliding member 322, and link member 310.

Optionally, Automatic Flush Bolts of the type herein described may be fitted with a heat-responsive mechanism for fire safety applications. In a preferred embodiment, such a mechanism is mounted on frame member 210 and is responsive to an ambient temperature of a preselected magnitude to operate to restrain the Automatic Flush Bolt against movement toward the disengaged position. In a preferred embodiment the heat responsive mechanism comprises a bi-metallic strip 324 which is adapted to lay flat against frame member 210 ("first position") when the ambient temperature is not above a preselected magnitude and to curve away from frame member 210 and into the path of sliding member 322 ("second position") when the ambient temperature exceeds the preselected magnitude. The curving of bimetallic strip 324 acts to impede the motion of sliding member 322 along track means 402 so as to restrain bolt member 202 from retraction or disengagement during conditions of high ambient temperature, as in a fire. Such bi-metallic responsive mechanisms are well known in the art.

When active door 108 is opened, trigger member 204 is released and, biased by spring 318, will again protrude through surface 112 allowing bolt member 202 to retract from the securing surface and the Automatic Flush Bolt to attain the disengaged position.

Optionally, a protrusion or pin may be placed along track 402 to limit movement of sliding member 322 as desired.

Figure 7:
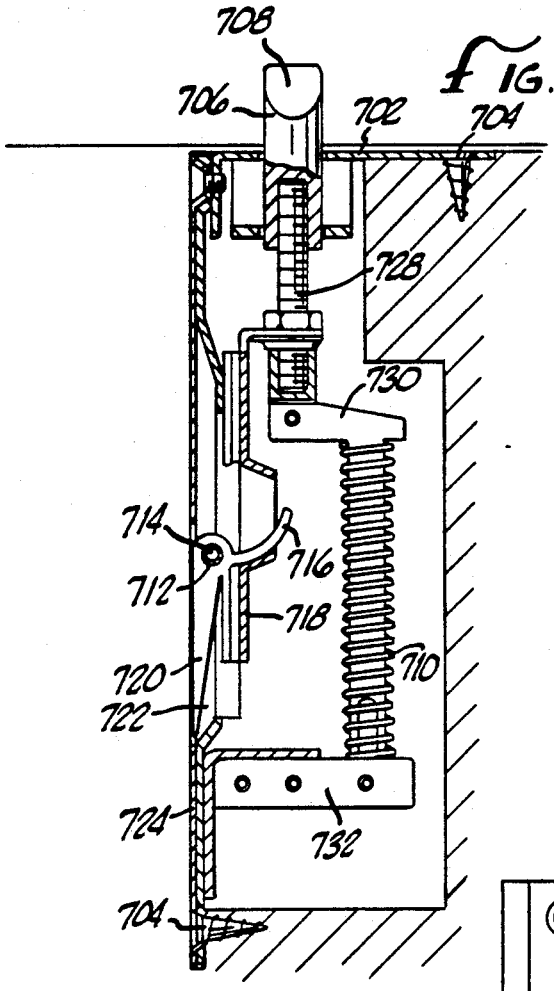
FIG. 7 is a cross-sectional view of a Semi-Automatic Flush Bolt according to the present invention in an engaged position.
Figure 8:
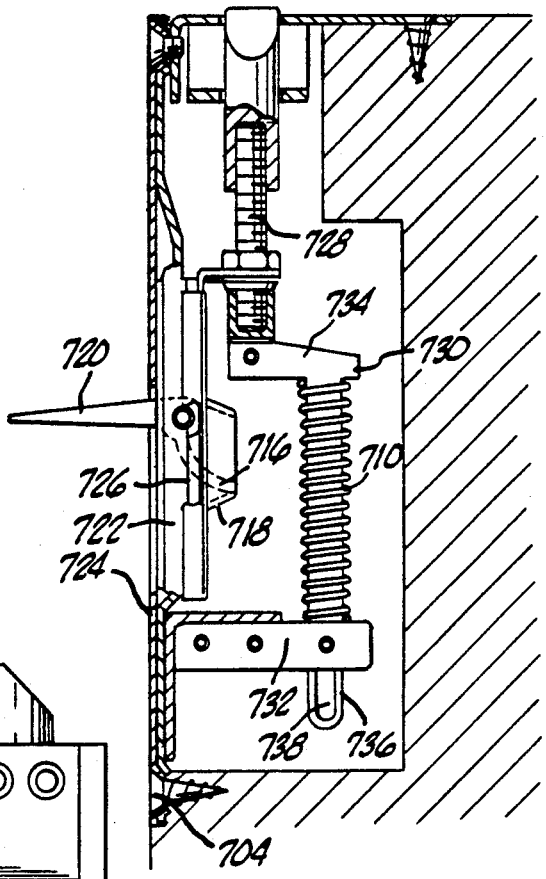
FIG. 8 is a cross-sectional view of a Semi-Automatic Flush Bolt according to the present invention in a disengaged position.
Figure 9:
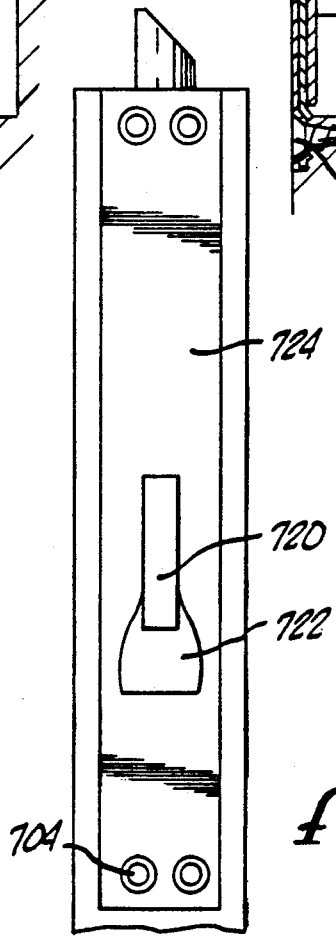
FIG. 9 is a front elevation of a Semi-Automatic Flush Bolt according to the present invention in an engaged position.

The Semi-Automatic Flush Bolt depicted in FIGS. 7, 8 and 9 includes frame member 702 which may be mounted to door 102 by fastening means such as screws 704, nails, rivets or other conventional means as well known in the art. The operation of the Semi-Automatic Flush Bolt differs somewhat from the operation of the Automatic Flush Bolt. In its relaxed condition, the Semi-automatic Flush Bolt has bolt member 706 extended to engage a securing surface. This is referred to as the engaged position. Thus regardless of whether the door is open or closed, the bolt member 706 is extended. In order to allow the door to close without damage occurring and without operator intervention, a bevelled surface 708 is provided to bolt member 706. When the door is closed and bolt member 706 begins to engage the securing surface, surface 708 will cause the weight of the door to force bolt member 706 down and out of the way. In this way the inactive door 102 may be closed without operator intervention or damage. This is referred to as override and operates in a similar manner to the override described above for the case of the Automatic Flush Bolt. Override bias is provided by spring 710 which is under compression. Bolt member 706 need not be of any particular cross section.

The Semi-Automatic Flush Bolt operates by means of a finger member or control member 712. Control member 712 is pivotally mounted to frame member 702 at pivot axis 714 and includes a lever arm 716 adapted to make sliding contact with a sliding member 718 and a control arm 720 adapted to lie flush within indentation 722 in a flush surface 724. Flush surface 724 is adapted to be mounted essentially flush with the free edge 112 of one 102 of the pair of swinging doors 100. The flush mounting is accomplished in the conventional manner known to those of skill in the art and is depicted in FIGS. 1, 2, 3, 4, 7, 8 and 11. The Semi-Automatic Flush Bolt is conventionally mounted at one or both corners of the free edge 112 of the inactive door. Optionally, a housing (not shown) made of a suitable material such as metal or plastic may cover the mechanism to aid in keeping dust or other extraneous matter away from the mechanism. Such housings are well known in the art and will not be discussed further herein.

When control arm 720 is relaxed bolt member 706 is extended. When control arm 720 is rotated clockwise as depicted in FIG. 8, this action rotates lever arm 716 clockwise causing it to push against sliding member 718. This in turn causes the withdrawal of bolt member 706 and causes the Semi-Automatic Flush Bolt to attain the disengaged state. Sliding member 718 operates in a similar manner to sliding member 322 discussed above. Frame member 702 includes track means 726 as depicted in FIGS. 2, 3 and 4. Track means 726 of one preferred embodiment may be a pair of rails pressed out of frame member 702 which slidably engage sliding member 718. In another preferred embodiment, track means may consist of a guide or series of guides attached to frame member 702 through which a sliding member could slidably engage frame member 702. For example, a sliding member of circular cross-section could be supported by a series of brackets having holes of similar cross-section therethrough.

Sliding member 718 is locked to the motion of bolt member 706 and slides relative to the frame member.

In a preferred embodiment, bolt member 706 is attached to sliding member 718 via rod member 728. Link member 730 is also attached to bolt member 706 via rod member 728. Link member 730 has a first end 734 and a second end 736. Attachment of link member 730 to rod member 728 may be at any convenient point along rod member 728 and need not be limited as depicted in FIGS. 7 and 8. For example, in a preferred embodiment, link member 730 may be attached to rod member 728 at a point closer to bolt member 706 than the point of attachment between rod member 728 and sliding member 718.

Spring 710 is, in a preferred embodiment, a helical spring mounted coaxial with link member 730. Bracket 732 is a part of frame member 702. In a preferred embodiment the second end 736 of link member 730 is attached to bracket 732 in a manner similar to that depicted in FIG. 5 for the Automatic Flush Bolt and which will not be repeated here. Spring 710 biases link member 730 against frame member 702 via bracket 732 to bias the Semi-automatic Flush Bolt toward the engaged position as depicted in FIG. 7. This is referred to as position bias. In a preferred embodiment, both position bias and override bias are provided by a single spring 710 which is under compression.

Slot 738 in the second end 736 of link member 730 is provided to allow motion of bolt member 706 between the engaged and disengaged positions. Those of skill in the art will recognize that other configurations allowing relative motion between bolt member 706 and bracket 732 are possible without departing from the inventive aspects of this disclosure.

As set forth above, the term bolt-slide assembly refers to the structure comprised of bolt member 706, rod member 728, sliding member 718, and link member 730.

While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. An automatic flush bolt for flush mounting on the free edge of one of a pair of swinging doors and operation between an engaged position with a securing surface and a disengaged position, said automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member; and a spring under compression for biasing the automatic flush bolt to a preselected position.

2. The automatic flush bolt of claim 1 wherein said preselected position is the disengaged position.

3. An automatic flush bolt for flush mounting on the free edge of one of a pair of switching doors and operation between an engaged position with a securing surface and a disengaged position, said automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member;

a spring under compression for biasing the automatic flush bolt to a preselected position; wherein:

said spring is a helical spring mounted coaxial with said link member;

said second end of said link member includes a slot; and a distal end of said are is capable of motion relative to said link member about said slot.

4. The automatic flush bolt of claim 1 wherein said spring comprises a single helical spring coaxial with said link member.

5. The automatic flush bolt of claim 1 wherein a heat-responsive mechanism is mounted on said frame member and is responsive to an ambient temperature of a preselected magnitude to operate to restrain the automatic flush bolt against movement toward the disengaged position.

6. The automatic flush bolt of claim 5 wherein said heat-responsive mechanism includes a bi-metallic strip adapted to assume a first portion when said ambient temperature is not above said pre-selected magnitude and to assume a second position in the path of said sliding member when said ambient temperature is above said pre-selected magnitude.

7. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

said frame member including track means along a slide thereof opposite said surface, said track means running parallel the free edge;

a bolt-slide assembly slidably engaged with said track means, said bolt-slide assembly having a link member and a sliding member;

a spring mounted coaxially with said link member;

a trigger member;

a cam member adapted to make contact with said trigger member;

said cam member having an arm and a pivot axis, said cam member connected to said frame member at said pivot axis, said arm pivotally connected to said link member, and a washer in contact with said arm and said spring.

8. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

said frame member including track means along a side thereof opposite said surface, said track means running parallel the free edge;

a bolt-slide assembly slidably engaged with said track means, said bolt-slide assembly having a link member and a sliding member;

a spring mounted coaxially with said link member;

a trigger member;

a cam member adapted to make contact with said trigger member;

said cam member having an arm and a pivot axis, said cam member connected to said frame member at said pivot axis and said arm pivotally connected to said link member;

said spring additionally including a first spring end and a second spring end, said first spring end in contact with said link member and said second spring end in contact with said arm.

9. The automatic flush bolt of claim 8 wherein said spring is in compression.

10. The automatic flush bolt of claim 9 wherein said spring is mounted coaxial with said bolt-slide assembly for biasing the automatic flush bolt to a preselected position.

11. The automatic flush bolt of claim 10 wherein said arm is slidably connected to said link member.

12. The automatic flush bolt of claim 11 wherein said preselected position is the disengaged position.

13. The automatic flush bolt of claim 12 wherein:

said second end of said link member includes a slot; and a distal end of said arm is capable of motion relative to said link member about said slot.

14. The automatic flush bolt of claim 13 wherein a heat-responsive mechanism is mounted on said frame member and is responsive to an ambient temperature of a preselected magnitude to operate to restrain the automatic flush bolt against movement toward the disengaged position.

15. The automatic flush bolt of claim 14 wherein said heat responsive mechanism includes a bi-metallic strip adapted to assume a first position when said ambient temperature is not above said pre-selected magnitude and to assume a second position in the path of said sliding member when said ambient temperature is above said pre-selected magnitude.

16. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring for biasing the automatic flush bolt to a preselected position; and said spring under compression.

17. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring for biasing the automatic flush bolt to a preselected position;

said spring under compression;

said spring additionally including a first spring end and a second spring end, said first spring end in contact with said first end of said link member and said second spring end in contact with said arm.

18. The automatic flush bolt of claim 17 wherein said spring is mounted coaxial with said link member for biasing the automatic flush bolt to a preselected position.

19. The automatic flush bolt of claim 18 wherein said arm is slidably connected to said link member.

20. The automatic flush bolt of claim 19 wherein said preselected position is the disengaged position.

21. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring for biasing the automatic flush bolt to a preselected position;

said spring under compression;

said second end of said link member including a slot; and a distal end of said arm capable of motion relative to said link member about said slot.

22. An automatic flush bolt for flush mounting on the free edge of one of a pair of swinging doors and operation between an engaged position with a securing surface and a disengaged position, said automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member; and a spring for providing bias to said arm.

23. The automatic flush bolt of claim 22 wherein said spring is under compression.

24. The automatic flush bolt of claim 23 wherein said spring is mounted coaxial with said link member.

25. An automatic flush bolt for flush mounting on the free edge of one of a pair of swinging doors and operation between an engaged position with a securing surface and a disengaged position, the automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member;

a spring under compression for providing both position bias and override bias for the automatic flush bolt;

said spring coaxial with said link member;

said first end of said link member including a spring anchor, said first spring end of said spring in contact with said spring anchor, and said second spring end of said spring in contact with said arm.

26. An automatic flush bolt mounting on the free edge of one of a pair of swinging doors and operation between an engaged position with a securing surface and a disengaged position, the automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member;

a spring under compression and coaxial with said link member for providing both position bias and override bias for the automatic flush bolt;

said bolt-slide assembly including a rod member, said first end of said link member including a slot therethrough, said link member in contact with said rod member, said first spring end of said spring in contact with said rod member, and said second spring end of said spring in contact with said arm.

27. An automatic flush bolt for flush mounting on the free edge of one of a pair of swinging doors and operation between an engaged position with a securing surface and a disengaged position, said automatic flush bolt comprising:

a frame member having a surface for mounting essentially flush with the free edge of one of the pair of swinging doors;

said frame member including a track formed of a pair of rails;

a bolt-slide assembly including a sliding member slidably engaged with said track and a link member having a first end and a second end;

a trigger member;

a cam member adapted to make contact with said trigger member;

said cam member including an arm and a pivot axis, said cam member connected to said frame member at said pivot axis and said arm connected to said second end of said link member; and a spring under compression for biasing the automatic flush bolt to a preselected position.

28. The automatic flush bolt of claim 27 wherein:

said spring is a helical spring coaxially surrounding said link member.

29. An automatic flush bolt for flush mounting on the free edge of one of a pair of swinging doors and operation between an engaged position with a securing surface and a disengaged position, said automatic flush bolt comprising:

a frame member having a surface for mounting essentially flush with the free edge of one of the pair of swinging doors;

said frame member including a track formed of a pair of rails;

a bolt-slide assembly including a sliding member slidably engaged with said track and a link member having a first end and a second end;

a trigger member;

a cam member adapted to make contact with said trigger member;

said cam member including an arm and a pivot axis, said cam member connected to said frame member at said pivot axis and said arm connected to said second end of said link member; and a spring under compression for biasing the automatic flush bolt to a preselected position; wherein said second end of said link member includes a slot; and a distal end of said arm is capable of motion relative to said link member about said slot.

30. The automatic flush bolt of claim 29 wherein:

said spring coaxially surrounds said link member.

31. The automatic flush bolt of claim 27 wherein a heat-responsive mechanism is mounted on said frame member and is responsive to an ambient temperature of a preselected magnitude to operate to restrain the automatic flush bolt against movement toward the disengaged position.

32. The automatic flush bolt of claim 31 wherein said heat-responsive mechanism includes a bi-metallic strip adapted to assume a first position when said ambient temperature is not above said pre-selected magnitude and to assume a second position in the path of said sliding member when said ambient temperature is above said pre-selected magnitude.

33. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

said frame member including track means along a side thereof opposite said surface, said track means running parallel the free edge;

a bolt-slide assembly slidably engaged with said track means, said bolt-slide assembly having a link member and a sliding member;

a spring coaxially surrounding said link member;

a trigger member;

a cam member adapted to make contact with said trigger member;

said cam member having an arm and a pivot axis, said cam member connected to said frame member at said pivot axis, said arm pivotally connected to said link member, and a washer in contact with said arm and said spring.

34. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

said frame member including track means along a side thereof opposite said surface, said track means running parallel the free edge;

a bolt-slide assembly slidably engaged with said track means, said bolt-slide assembly having a link member and a sliding member;

a spring coaxially surrounding said link member;

a trigger member;

a cam member adapted to make contact with said trigger member;

said cam member having an arm and a pivot axis, said cam member connected to said frame member at said pivot axis and said arm pivotally connected to said link member;

said spring additionally including a first spring end and a second spring end, said first spring end in contact with said link member and said second spring end in contact with said arm.

35. The automatic flush bolt of claim 34 wherein said spring is in compression.

36. The automatic flush bolt of claim 35 wherein said arm is slidably connected to said link member.

37. The automatic flush bolt of claim 36 wherein:

said second end of said link member includes a slot; and a distal end of said arm is capable of motion relative to said link member about said slot.

38. The automatic flush bolt of claim 37 wherein a heat-responsive mechanism is mounted on said frame member and is responsive to an ambient temperature of a preselected magnitude to operate to restrain the automatic flush bolt against movement toward the disengaged position.

39. The automatic flush bolt of claim 38 wherein said heat-responsive mechanism includes a bi-metallic strip adapted to assume a first position when said ambient temperature is not above said pre-selected magnitude and to assume a second position in the path of said sliding member when said ambient temperature is about said pre-selected magnitude.

40. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring coaxially surrounding said link member for biasing the automatic flush bolt to a preselected position; and said spring under compression.

41. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring coaxially surrounding said link member for biasing the automatic flush bolt to a preselected position;

said spring under compression;

said spring additionally including a first spring end and a second spring end, said first spring end in contact with said first end of said link member and said second spring end in contact with said arm.

42. The automatic flush bolt of claim 41 wherein said arm is slidably connected to said link member.

43. The automatic flush bolt of claim 42 wherein:

said second end of said link member includes a slot; and a distal end of said arm is capable of motion relative to said link member about said slot.

44. An automatic flush bolt for flush mounting on the free edge of one of a pair of swinging doors and operation between an engaged position with a securing surface and a disengaged position, the automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member; and a spring under compression coaxially surrounding said link member and which provides bias to said arm.

45. The automatic flush bolt of claim 44 wherein said spring also provides bias against said link member.

46. An automatic flush bolt for flush mounting on the free edge of one of a pair of swinging doors and operation between an engaged position with a securing surface and a disengaged position, the automatic flush bolt comprising:

a frame member having a surface for mounting essentially flush with the free edge of one of the pair of swinging doors;

said frame member including a track;

a bolt-slide assembly slidably engaged with said track, said bolt-slide assembly including a sliding member and a link member, said link member having a first end and a second end;

a trigger member;

a cam member adapted to make contact with said trigger member;

said cam member including an arm and a pivot axis, said cam member connected to said frame member at said pivot axis and said arm connected to said second end of said link member;

a spring under compression coaxially surrounding said link member for providing both position bias and override bias for the automatic flush bolt;

said first end of said link member including a spring anchor, said first spring end of said spring in contact with said spring anchor, and said second spring end of said spring in contact with said arm.

47. The automatic flush bolt of claim 46 wherein said bolt-slide assembly includes a rod member, said first end of said link member includes a slot therethrough, said link member is in sliding contact with said rod member, said first spring end of said spring is in contact with said rod member, and said second spring end of said spring is in contact with said arm.

48. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

said frame member including track means along a side thereof opposite said surface, said track means running parallel the free edge;

a bolt-slide assembly slidably engaged with said track means, said bolt-slide assembly having a link member and a sliding member;

a spring mounted coaxially with said link member;

a trigger member;

a cam member adapted to make contact with said trigger member;

said cam member having an arm and a pivot axis, said cam member connected to said frame member at said pivot axis and said arm pivotally connected to said link member;

said spring including a first spring end and a second spring end, said first spring end in contact with said link member and said second spring end in contact with a washer, said washer in contact with said arm.

49. An automatic flush bolt for flush mounting on the free edge of one of a pair of swinging doors and operation between an engaged position with a securing surface and a disengaged position, said automatic flush bolt comprising:

a frame member having a surface adapted to be mounted essentially flush with the free edge of one of the pair of swinging doors;

a sliding member slidably engaged with said frame member;

a link member having a first end and a second end;

a bolt member attached to said sliding member and to said first end of said link member;

a trigger member extending through said surface;

a cam member in contact with said trigger member;

said cam member having a pivot axis and an arm including a distal end, said cam member connected to said frame member at said pivot axis and said distal end of said arm connected to said second end of said link member;

a spring under compression for biasing the automatic flush bolt to a preselected position and including a first spring and a second spring end, said first spring end in contact with said link member and said second spring end in contact with a washer, said washer in contact with said arm.

* * * * *

UNITED STATES PATENT AND TRADEMARK OFFICE

CERTIFICATE OF CORRECTION

PATENT NO. : 5,076,620

DATED : December 31, 1991

INVENTOR(S) : Andrew B. Campbell et al.

It is certified that error appears in the above-identified patent and that said Letters Patent is hereby corrected as shown below:

In claim 3 (col. 7, l. 30), delete "switching" and insert therefor -- swinging --.

In claim 3 (col. 7, l. 55), delete "are" and insert therefor -- arm --.

In claim 7 (col. 8, l. 14), delete "slide" and insert therefor -- side --.

In claim 39 (col. 13, l. 47) delete "about" and insert therefor -- above --.

Signed and Sealed this

Sixth Day of July, 1993

*Attest:*

Michael K. Kirk

MICHAEL K. KIRK

*Attesting Officer*

*Acting Commissioner of Patents and Trademarks*